US009799439B2

(12) United States Patent
Sjöberg et al.

(10) Patent No.: US 9,799,439 B2
(45) Date of Patent: Oct. 24, 2017

(54) ELECTRICAL POWER COMPONENT CONTAINING AN INSULATING FLUID AND A CONDENSER CORE

(71) Applicant: ABB Schweiz AG, Baden (CH)

(72) Inventors: Peter Sjöberg, Ludvika (SE); Robert Floresjö, Borlänge (SE); Simon Lindgren, Borlänge (SE); Thomas Eriksson, Ludvika (SE); Anders Östlund, Borlänge (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/948,452

(22) Filed: Nov. 23, 2015

(65) Prior Publication Data

US 2016/0148744 A1 May 26, 2016

(30) Foreign Application Priority Data

Nov. 24, 2014 (EP) ..... 14194478

(51) Int. Cl.
*H01F 27/14* (2006.01)
*H01B 17/34* (2006.01)
*H01B 17/28* (2006.01)

(52) U.S. Cl.
CPC ..... *H01F 27/14* (2013.01); *H01B 17/34* (2013.01); *H01B 17/28* (2013.01)

(58) Field of Classification Search
CPC ..... H01B 17/34; H01B 3/20; H01F 27/14
See application file for complete search history.

(56) References Cited

U.S. PATENT DOCUMENTS 1,790,718 A * 2/1931 Palueff ..... H01G 4/22 174/12 BH
3,405,066 A * 10/1968 McGhee ..... H01B 3/20 174/17 LF
3,604,830 A * 9/1971 Frakes ..... H01B 17/34 174/143
3,992,155 A * 11/1976 Nilsson ..... G01N 27/16 137/99

(Continued)

FOREIGN PATENT DOCUMENTS

GB 283930 A 4/1928
GB 1445025 A 8/1976
JP S5214998 U 2/1977

OTHER PUBLICATIONS

European Search Report Application No. 14 19 4478 Completed: Apr. 24, 2015; Mailing Date: May 8, 2015 5 pages.

*Primary Examiner* — William H Mayo, III
*Assistant Examiner* — Hiram E Gonzalez
(74) *Attorney, Agent, or Firm* — Whitmyer IP Group LLC

(57) ABSTRACT

An electrical power component, such as a bushing. The power component includes a housing, a condenser core arranged in the housing and including an electrical insulation, a space formed between the condenser core and the housing, an expansion vessel positioned adjacent and in open communication with the space between the condenser core and the housing, and an electrically insulating fluid, such as oil, contained in the space between the condenser core and the. The power component further includes one or more filler elements having a higher density and lower thermal expansion coefficient than the fluid, and the one or more filler elements are movably arranged in the expansion vessel.

18 Claims, 2 Drawing Sheets

(56) References Cited

U.S. PATENT DOCUMENTS

| | | | | |
|---|---|---|---|---|
| 4,123,618 | A | 10/1978 | Cushing et al. | |
| 2001/0022235 | A1 | 9/2001 | Villa et al. | |
| 2015/0294753 | A1* | 10/2015 | Ramon Raygoza ... | B82Y 30/00<br>252/572 |

* cited by examiner

ELECTRICAL POWER COMPONENT CONTAINING AN INSULATING FLUID AND A CONDENSER CORE

FIELD OF THE INVENTION

The present invention relates to electrical power components containing an insulating fluid and a condenser core, such as bushings, and instrument transformers. The invention particularly relates to electrically insulating bushings for high voltage electrical equipment, for example transformers and reactors. The invention relates in particular to oil impregnated bushings.

BACKGROUND OF THE INVENTION

Electrical power components, such as capacitors, bushings, and instrument transformers, comprise a condenser core arranged in, surrounded by an electrically insulating housing. The condenser core includes at least one conductor extending along a longitudinal axis of the housing and an electrical insulation surrounding the conductor. The electrical insulation surrounding the conductor is, for example, made of wounded paper impregnated with oil. A space is formed between the condenser core and the housing. The space between the condenser core and the housing contains an insulating fluid to impregnate the insulation surrounding the conductor. The insulating fluid is usually oil. During operation and/or when the ambient temperature of the power component is increasing, the temperature of the oil is increased and by that the volume of the oil is increased. In order to avoid increased pressure in the housing when the temperature of the oil is increased, the power component is provided with an expansion vessel positioned adjacent and in open communication with the space between the condenser core and the housing. There is an open gap between the expansion vessel and the condenser core. The expansion vessel is at least partially filled with a compressible gas volume, which is in direct contact with the surface of the oil. When the volume of the oil increases, the increased volume of the oil is expanded into the expansion vessel and the gas is compressed.

A disadvantage with such a power component is that during transportation and storage, when the component is held in a horizontal position due to its length, a part of the oil flows into the expansion vessel and the position of the gas volume is moved in the expansion vessel. This may cause the oil level in the housing to reach below the winded insulation surrounding the conductor. A consequence of this is that the insulation of the condenser core is exposed to gas from the expansion vessel, which may cause damage of the impregnation of the winded insulation of the condenser core. If the power component is taken into operation too quickly after it has been raised and before it has been fully impregnated, partial discharge (PD) can occur. This can drastically decrease the life time of the component or even destroy the component right away. This can be an even bigger problem if it is the only spare component on site. Also, if it is a spare component, there is often a big hurry to get the transformer going again. The quantity of the PD activities is often very small, which makes it hard to measure. Because of this, an oil impregnated component needs to be vertically mounted for several days before it is re-impregnated, and safe to take into operation again.

One solution to this problem is to arrange the expansion vessel asymmetrically in relation to the condenser core. A disadvantage with this solution is that the oil will flow into the expansion vessel and the insulation of the condenser core will not be covered with oil if the component is turned upside down when it is held in a horizontal position.

GB1 445 025 discloses an electrically insulated bushing, whereby gas that is present in the housing above the level of the insulation oil, is prevented from dissolving in the oil by using closed compressible gas container in the housing. These containers are wound around the conductor inside the housing. The housing can be filled with oil, and the gas container can be filled with gas from an exterior of the bushing. This is a complex and rather expensive solution to the problem and there is always a risk that leakage can occur between the gas volume and the oil volume.

SUMMARY OF THE INVENTION

It is an object of the present invention to at least partly overcome the above problem, and to provide an improved electrical power component.

This object is achieved by a power component as defined in the invention.

The electrical power component comprises a housing, a condenser core arranged in the housing and including an electrical insulation, a space formed between the condenser core and the housing, an expansion vessel containing an expansion gas and positioned adjacent and in open communication with the space between the condenser core and the housing, and an electrically insulating fluid contained in the space between the condenser core and the housing. The invention is characterized in that the power component comprises one or more filler elements having a higher density and lower thermal expansion coefficient than the fluid, and the one or more filler elements are movably arranged in the expansion vessel.

The coefficient of thermal expansion describes how the size of an object changes with a change in temperature, and is determined as the degree of expansion divided by the change in temperature.

According to the invention, one or more filler elements are arranged in the expansion vessel, which makes it possible to have the condenser core covered with oil when it is in a horizontal position without increasing the diameter of the expansion vessel or have an asymmetrical expansion vessel.

The filler elements replaces all or a part of the oil in the expansion vessel. Since the filler elements has a lower thermal expansion coefficient than the fluid, the filler elements does not expand as much as the fluid. This means that the thermally expanded volume of the fluid is reduced, and by that the necessary volume of expansion gas is reduced. The filler elements prevents the oil impregnated condenser core from coming into contact with the expansion gas because it will lower the necessary volume of expansion gas. The one or more filler elements reduce the need of fluid in the expansion vessel and therefore also reduce the needed volume of oil in the expansion vessel and thereby the necessary volume of gas. Due to this the power component can be stored horizontal or almost horizontal, without expose the oil impregnated core with gas.

The filler elements are movably arranged in the expansion vessel, which means that they are allowed to move with respect to the expansion vessel. The filler elements are made of a material having higher density than the fluid. Thus, the position of the filler element in the expansion vessel is determined by the gravity force acting on the element. The filler element works as a sinker and is always positioned in the lower part of the expansion when the power device is in horizontal or in an inclined position vessel and by that allows the expansion gas to be in the upper part of the expansion vessel, independent of the position of the component. Although the component can be turned around its longitudinal axis during transportation or after handling, the filler element is always positioned in the lower part of the vessel, and the expansion gas is always positioned in the upper part of the expansion vessel, and thus the condenser core will always be covered by the fluid.

The filler elements has no problem with trapped expansion gas below the expansion vessel. For example, if the power component has been upside down during transport, the filler elements has no problem with letting the gas up to the expansion vessel again.

The benefits are:

The power component can be taken into operation faster after it has been raised from the horizontal position.

It decreases the risk for failure of the power component.

It makes it possible to long time storage of the power component, in horizontal position, without risking damage of the oil impregnated core.

Further, this is a simple and low cost solution.

According to an embodiment of the invention, the expansion vessel is arranged above the condenser core when the component is in an upright position, and the inner diameter of the expansion vessel is larger than the inner diameter of the housing. By that there will always be a space in the upper part of the vessel for housing the expansion gas when the component is in a horizontal position and the power component is rotated about its longitudinal axis.

According to an embodiment of the invention, the one or more filler elements are freely movable in the expansion vessel. In this embodiment the filler elements are not attached to any part of the power component and is freely movable in at least three degrees of freedom. By that, movement of the filler elements are facilitated when the component is moved or rotated.

The filler elements can be made from any material that have a higher density and lower thermal expansion coefficient than the fluid and does not interfere with the power component at any way. The one or more filler elements are made of a solid material. Solid materials usually have higher density and lower thermal expansion coefficient than a fluid. For example, the one or more filler elements are made of polymer, metal, or ceramic, such as glass. For example, the fluid is oil.

According to an embodiment of the invention, the expansion vessel contains a plurality of the filler elements. Instead of having one large filler element, the expansion vessel can be filled with a number of small filler elements. For example, the expansion vessel can be filled with a number of small filler elements up to a level which is no higher than the fluid level at vertical position of the component. The geometry of the pieces can be balls, spheres, cubes, rectangles and so on.

According to an embodiment of the invention, the filler elements are spherical. It is advantageous to have spherical filler elements since they can be packed with high density and they can easily roll to the lower position in expansion vessel.

According to an embodiment of the invention, a fluid permeable barrier is arranged between the expansion vessel and the space in order to hold the filler elements inside the expansion vessel. The barrier permits the fluid to move between the expansion vessel and the space, but prevents the filler elements from moving from the expansion vessel into the space between the condenser core and the housing. If a number of small pieces of filler elements is to be used, the expansion vessel needs a barrier between the expansion vessel and the condenser core. Otherwise the small pieces can fall down to the condenser core. The barrier can be a net, filter or something similar.

According to an embodiment of the invention, the expansion vessel contains one filler element having a size and shape, which at least partly correspond to the shape and size of the expansion vessel.

For example, the filler element is shaped as a part of a cylinder. Since the shape of the expansion vessel often is cylindrical, it is advantageous to have one filler element formed as a part of a cylinder, for example as a half cylinder.

According to an embodiment of the invention, the filler element is shaped as a cylinder having an indentation for housing the expansion gas.

According to an embodiment of the invention, the component is an electrical bushing.

BRIEF DESCRIPTION OF THE DRAWINGS

The invention will now be explained more closely by the description of different embodiments of the invention and with reference to the appended figures.

DETAILED DESCRIPTION OF THE INVENTION

Figure 1:
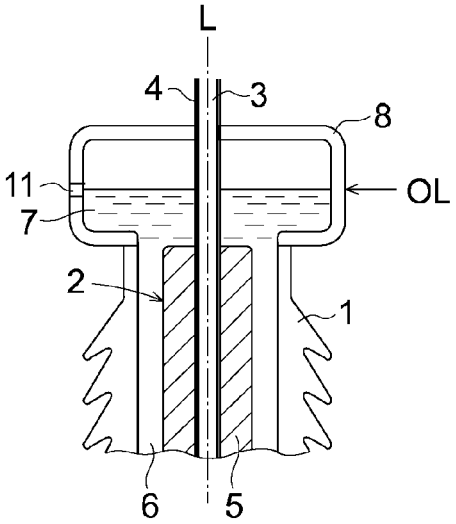
FIG. 1 shows a prior art power component at room temperature and placed in a vertical position.
Figure 2:
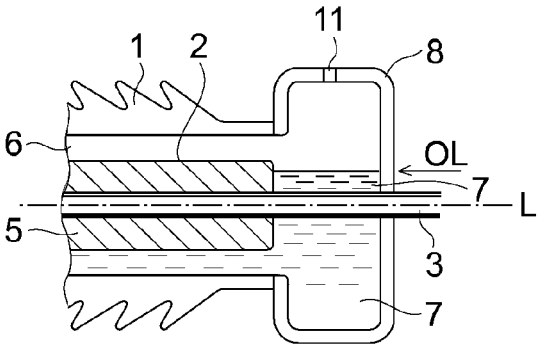
FIG. 2 shows the prior art power component at room temperature and placed in a horizontal position.

FIG. 1 shows a prior art power component in the form of a bushing at room temperature and placed in a vertical position. FIG. 2 shows the bushing placed in a horizontal position. The power component comprises a housing 1 made of an electrically isolating material, for example a polymer or porcelain. The bushing further comprises a condenser core 2 positioned inside the housing 1. In this example, the power component includes a conductor 3 extending through the housing along a longitudinal axis L. In this example, the conductor 3 is enclosed by a winding tube 4. The condenser core 2 includes an electrical insulation 5. In this example, the electrical insulation 5 is wound around the winding tube 4. The winding tube 4 is optional and can be replaced by the conductor. In that case, the electrical insulation 5 is wound directly on the conductor 3. Further, the conductor 3 is optional and can be replaced by the winding tube 4. The electrical insulation 5 is, for example, a plurality of turns of paper wound around the winding tube 4 or the conductor 3. The condenser core 2 may also include metal foil wound between the paper windings. In the following, the electrical insulation 5 is named the winded insulation.

A space 6 is formed between the condenser core 2 and the housing 1. This space is filled with an electrically insulating fluid 7, for example oil. The insulating fluid is also used to impregnate the winded insulation surrounding the conductor. The component further comprises an expansion vessel 8 positioned above the housing 1 and in open communication with the space 6 between the condenser core and the housing. The expansion vessel 8 is fixedly connected to the housing. The conductor 3 and the winding tube 4 extend through the housing 1 and the expansion vessel 8. The electrical insulation 5 surrounds the part of the conductor 3 positioned in the housing 1. The electrical insulation 5 ends below the expansion vessel. There is at least one opening between the expansion vessel 8 and the space 6 to allow the fluid to expand into the expansion vessel.

Some power components are provided with a fluid level indicators, for example a sight glass 11, showing the fluid level to enable supervision of the fluid level. Preferably, the fluid 7 inside the expansion vessel at room temperature reaches the sight glass 11, when the fluid level indicator is of this type. Above the fluid level OL, there is a volume filled with an expansion gas. The expansion gas is, for example, air or nitrogen.

In this example, the housing and the expansion vessel are cylindrically shaped. The diameter of the expansion vessel 8 can often be larger than the diameter of the housing 1, but always larger than the diameter of the condenser core. In this example, the expansion vessel has an inner diameter of about 220 mm and the inner height of the expansion vessel is about 100 mm. The sight glass 11 is positioned at a height of about 65 mm from the bottom of the expansion vessel. This means that the volume of the fluid in the expansion vessel is about 2.5 l.

When the bushing is held in a horizontal position, as seen in FIG. 2, the fluid will flow from the space 6 and into the expansion vessel 8, and the level OL of the fluid 7 is below the upper level of the insulation 5 of the condenser core 2 and accordingly the winded insulation is in contact with the expansion gas. The winded insulation 5 of the condenser core will not be covered with fluid when the component is horizontally positioned, and the winded insulation will be exposed to the expansion gas. One solution to this problem is to increase the amount of fluid in the component. However, if the amount of fluid in the component is increased, the volume of expansion vessel must be increased correspondingly due to a larger expansion of the total fluid volume. This is not an attractive solution since there exists standards that put limits on the size of the expansion vessel.

In the following, the invention will be described in connection to a bushing. However, the invention can be used for other types of electrical power components including a condenser core, for example, instrument transformers.

In the figures, the same and corresponding parts are designated by the same reference numerals as for the prior art component disclosed in FIGS. 1 and 2.

Figure 3:
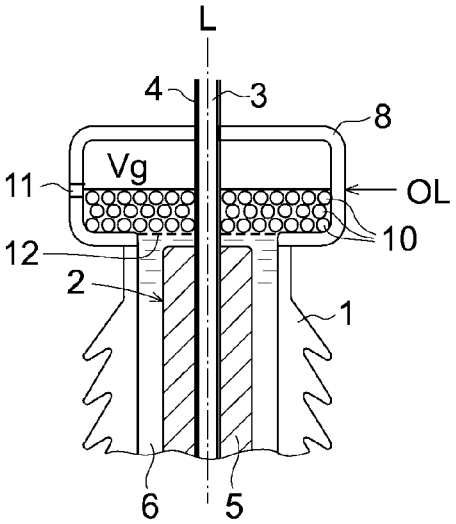
FIG. 3 shows a power component according to a first embodiment of the invention at room temperature and placed in a vertical position.
Figure 4:
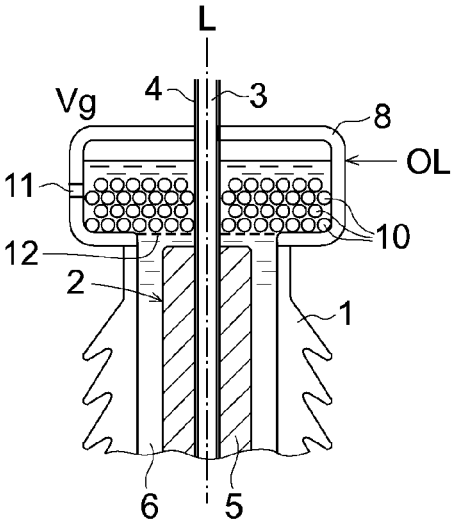
FIG. 4 shows the power component according to the first embodiment at operating temperature and placed in a vertical position.
Figure 5:
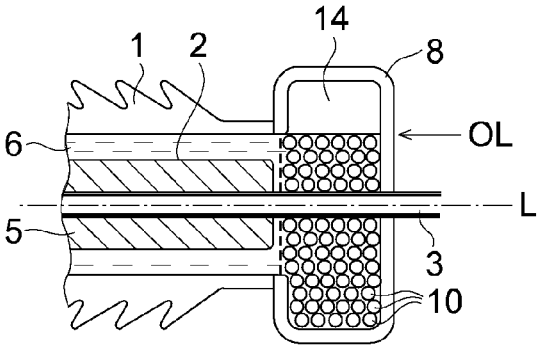
FIG. 5 shows the power component according to the first embodiment at room temperature and placed in a horizontal position.

FIGS. 3-5 shows an electrical power component according to a first embodiment of the invention. FIG. 3 shows the power component at room temperature and placed in a vertical position, and FIG. 4 shows the power component at operating temperature and placed in a vertical position. FIG. 5 shows the power component at room temperature and placed in a horizontal position.

According to the invention, the electrical power component comprises one or more filler elements 10 made of a material having a higher density and lower thermal expansion coefficient than the fluid. The filler elements are movably arranged in the expansion vessel. The filler elements can be made from any material that have a higher density and lower thermal expansion coefficient than the fluid 7. The filler elements are, for example, made of ceramic, metal or a polymer material. Suitably, the filler elements are made of glass or metal. In this embodiment, a plurality of filler elements are positioned in the expansion vessel. The filler elements are loosely arranged in the expansion vessel and are free to move in the expansion vessel in dependence on the gravity force acting on the filler elements. Thus, the filler elements will always be positioned in a bottom part of the expansion vessel even though the component is rotated about the longitudinal axis L and the component is horizontally positioned. The main difference between the prior art bushing disclosed in FIGS. 1-2 is that a part of the oil in the bushing has been replaced with the filler elements. In this embodiment the filler elements are balls. However the filler elements can have different shapes such as spheres, ovals, cubes, rectangles and so on. To prevent the filler elements from entering the space between the condenser core and the housing, the expansion vessel is provided with a barrier 12 position between the expansion vessel 8 and the space 6. Otherwise the small filler elements 10 can fall down into the space 6. The barrier is provided with a plurality of small openings to allow the fluid to enter into the expansion vessel. The barrier 12 can be a net, filter or something similar.

The component in FIG. 3 is shown at room temperature. If the component is provided with a sight glass for showing the fluid level, the fluid inside the expansion vessel preferably should reach the sight glass. Above the fluid level OL, there is a volume $V_g$ filled with an expansion gas.

The coefficient of thermal expansion K describes how the size of an object changes with a change ΔT in temperature, and is determined as the degree of expansion ΔV divided by the change in temperature for the object. Oil has a large coefficient of thermal expansion, and accordingly the expansion of the oils is high when the temperature increases in the oil.

The following expression describes the relation between the change in volume and the change in temperature of the fluid:

$$\Delta V = V_T * \Delta T * K$$

ΔV=Expansion of the volume of the fluid due to a temperature change in the fluid $V_T$=Total volume of fluid in the power component ΔT=Change of the average temperature in the fluid K=Coefficient of thermal expansion for the fluid This means that the volume Vg of the expansion gas must be larger than the change in volume of the fluid:

$$Vg > \Delta V$$

Vg=Volume for the expansion gas in the expansion vessel

FIG. 4 shows the component at an operating temperature that is considerable higher than the room temperature. At the room temperature the fluid level OL is leveled with the sight glass 11 and covers the filler elements 10. Due to the expansion ΔV of the fluid, the fluid level OL in the expansion vessel is higher in FIG. 4 than in FIG. 3. As seen in FIG. 4 there is still a volume containing the compression gas above the fluid level in the expansion vessel.

According to the invention, all or at least most of the fluid in the expansion vessel in FIG. 1 is replaced with one or more filler elements 10.

$$V_{exp} = V_F + V_g + V_O$$

$V_F > 0$ $V_{exp}$=The volume of the expansion vessel $V_F$=The volume of the filler elements in the expansion vessel $V_O$=The volume of the fluid in the expansion vessel The following expression should then be fulfilled:

$$\Delta V < V_{exp} - V_F - V_O$$

The relation between the volumes of fluid and filler elements in the expansion vessel depends on the shape of the expansion vessel and the overall design and may vary. The expansion vessel can, for example, be filled with filler elements 10 up to a level which is about the same as the level of the fluid at room temperature, as seen in FIG. 3. However, in another embodiment, the expansion vessel can be filled with filler elements 10 to a level above or below the fluid level. When filler elements are used, the fluid volume in the expansion vessel should be reduced with the volume of the filler elements which are beneath the fluid surface. Preferably, the volume $V_F$ of the one or more filler elements is equal or larger than the volume $V_O$ of the insulating fluid in the expansion vessel. More preferably, the volume $V_F$ of the one or more filler elements is at least twice the volume $V_O$ of the insulating fluid in the expansion vessel. Most preferably, the volume $V_O$ of the insulating fluid in the expansion vessel is close to zero.

Due to the fact that the filler elements 10 have a low or negative coefficient of thermal expansion, the expansion of the filler element due to the change ΔT of temperature is negligible. By that the volume $V_g$ of the necessary expansion gas is reduced compared to the prior art component, which makes it possible to make a smaller expansion vessel. Thus, the necessary volume of the expansion gas is reduced due to the fact that the filler elements have a lower or negative heat expansion coefficient than the fluid.

As explained above with reference to FIGS. 1 and 2, the volume of the oil in the expansion vessel in the prior art component is about 2.5 l. In the example disclosed in the FIGS. 3-5, about 80% of the volume of the oil in the expansion vessel is removed and the expansion vessel has been filled with filler elements 10 up to the level of the sight glass 11. This means that the volume VO of the oil in the vessel is 0.5 l and the volume VF of the filler elements is 2 l. The gas expansion volume Vg above the sight glass is then 1.3 l. The expansion volume Vg should be at least 1/7 of the total oil volume in the component. This means that if the total volume of oil in the power component is 8 l, the expansion gas volume should be at least 1.14 l. Thus, the condition for the necessary expansion volume is fulfilled.

In the following an example a prior art bushing without filler elements is compared with a bushing with filler elements according to the invention. The only difference between the bushings is that a part of the oil has been replaced with filler elements.

| Bushing without filler elements | Bushing with filler elements |
|---|---|
| $V_{tot}$: 11.4 l | 11.4 l |
| $V_{o\ tot}$: 10 l | 8.2 l |
| $V_g$: 1.4 l | 1.2 l |
| $V_F$: 0 | 2 l |

$V_{tot}$ = Total volume of the space and the expansion vessel $V_{o\ tot}$ = Total volume of oil in the space and the expansion vessel The total volume $V_{tot}$ is the same for both bushings. The total volume $V_{o\ tot}$ of oil in the bushing is decreased since a part of the oil has been replaced with filler elements. The volume of the necessary expansion gas $V_g$ is decreased from 1.4 to 1.2 liter, i.e. 1/7 of the total volume of oil.

FIG. 5 shows the power component of FIGS. 3 and 4 placed in a horizontal position and how the fluid level OL is affected by the filler elements 10. Due to the gravity, the freely movable filler elements 10 have been moved and is still in the bottom part of the expansion vessel 8. The fluid level OL is above the winded insulation 5 of the condenser core 4. Further, the fluid level OL is above the opening to the space 6 between the housing 1 and the winded insulation 5. By that, the expansion gas is trapped inside the expansion vessel and prevented from leaving the expansion vessel and to come into contact with the winded insulation of condenser core. The expansion gas is trapped in a volume 14 in an upper part of the expansion vessel. If the power component is rotated about the longitudinal axis L, the expansion gas will always be in the upper part of the vessel and the filler elements will always be in the lower part of the vessel. The fluid level in the expansion vessel is above the space 6 and by that expansion gas is trapped inside the expansion vessel and cannot be moved into the space 6. Thus, the power component can be stored horizontal or almost horizontal without exposing the condenser core with gas. The invention works also when the level of the fluid is below the expansion vessel.

Figure 6:
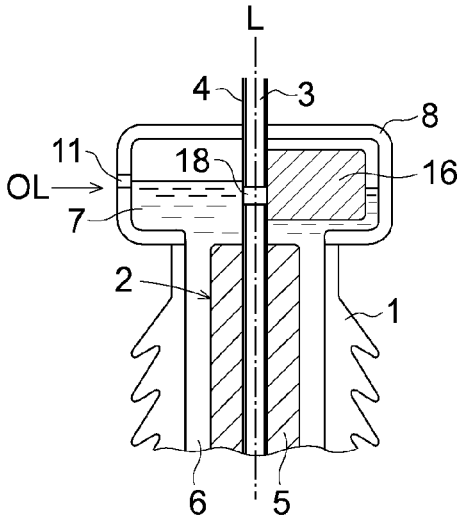
FIG. 6 shows a power component according to a second embodiment of the invention at room temperature and placed in a vertical position.
Figure 7:
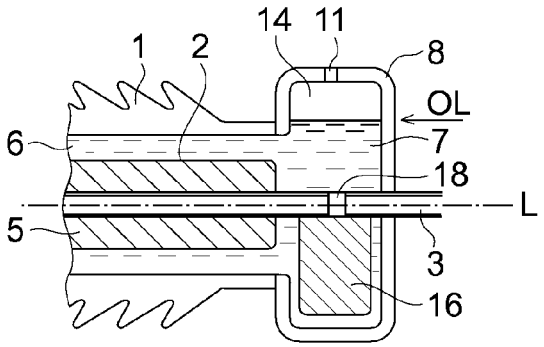
FIG. 7 shows the power component according to the second embodiment at room temperature and placed in a horizontal position.

FIGS. 6 and 7 show a component according to a second embodiment of the invention. In this embodiment, the expansion vessel only contains one filler element 16. The filler element 16 is shaped as a half cylinder and is movably attached to the winding tube 4. The filler element 16 can be rotated about the longitudinal axis L of the conductor. This means that the position of the filler element 16 is determined by the gravity force acting on the element. The filler element 16 will accordingly always be positioned in a lower part of the expansion vessel when the bushing has an inclination or is horizontal.

FIG. 7 shows the component placed in a horizontal position and how the fluid level OL is affected by the filler element 16. The fluid level OL is above the condenser core, and thus the winding insulation 5 is covered with fluid. The filler element 16 prevents the fluid impregnated winded insulation from contact with the expansion gas. This because the filler element lowers the total volume of the fluid and thereby the necessary volume of expansion gas. As can be seen from FIG. 7, the volume 14 of the expansion gas is trapped inside the expansion vessel also in the horizontal position. The gas is trapped in an upper part of the expansion vessel 8 between the fluid and the inner surface of the expansion vessel. The filler element 16 is rotatably connected to the winding tube 4 by means of a connection member 18.

The connection member 18 lets the filler element spin freely around the winding tube 4. Alternatively, the filler element 16 can slide against the wall of the expansion vessel, for example, having bearings against the surface of the wall of the vessel or bearings against the winding tube.

Figure 8:
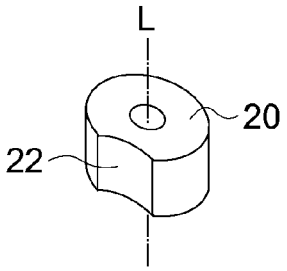
FIG. 8 shows an example of a filler element.

FIG. 8 shows another example of a filler element 20. The filler element 20 is shaped as a cylinder having an indentation 22 for housing the expansion gas. The filler element 20 is provided with a through hole for receiving the conductor 3 and/or the winding tube 4. The filler element 20 occupy most of the volume of the expansion vessel.

The present invention is not limited to the embodiments disclosed but may be varied and modified within the scope of the following claims. For example, the number, shape and material of the filler elements may vary. Further, the volume of the one or more filler elements may vary in different embodiments of the invention. For example, if the component does not have any sight glass it is possible to not have any fluid in the expansion vessel when the component is in a vertical position at room temperature. In such embodiment, the expansion vessel may only contain one or more filler elements and the expansion gas. The less fluid in the expansion vessel the better effect. In one embodiment, the volume of the filler elements may be larger than 50% of the total volume of the expansion vessel, or even larger than 60% of the total volume of the expansion vessel.

What is claimed is:

1. An electrical power component comprising:

a housing, a condenser core arranged in the housing and including an electrical insulation, a space formed between the condenser core and the housing, an expansion vessel containing an expansion gas and positioned adjacent and in open communication with the space between the condenser core and the housing, and an electrically insulating fluid contained in the space between the condenser core and the housing, one or more filler elements having a higher density and lower thermal expansion coefficient than the fluid, the one or more filler elements are movably arranged inside the expansion vessel, and a fluid permeable barrier arranged between the expansion vessel and the space in order to hold said one or more filler elements inside the expansion vessel.

2. The electrical power component according to claim 1, whereby the expansion vessel is arranged above the condenser core when the component is in a vertical position, and the inner diameter of the expansion vessel is larger than the inner diameter of the housing.

3. The electrical power component according to claim 1, whereby said one or more filler elements are made of a solid material.

4. The electrical power component according to claim 1, whereby said one or more filler elements are made of ceramic, metal or polymer.

5. The electrical power component according to claim 1, whereby said one or more filler elements are freely movable in the expansion vessel.

6. The electrical power component according claim 1, whereby the expansion vessel contains a plurality of said filler elements.

7. The electrical power component according to claim 6, whereby said filler elements are spherical.

8. The electrical power component according to claim 1, whereby the component is an electrical bushing.

9. An electrical power component comprising:

a housing, a condenser core arranged in the housing and including an electrical insulation, a space formed between the condenser core and the housing, an expansion vessel containing an expansion gas and positioned adjacent and in open communication with the space between the condenser core and the housing, and an electrically insulating fluid contained in the space between the condenser core and the housing, one or more filler elements having a higher density and lower thermal expansion coefficient than the fluid, the one or more filler elements are movably arranged inside the expansion vessel, and a conductor extending through the housing and the expansion vessel along a longitudinal axis of the housing, whereby the one or more filler elements are movably connected to the conductor.

10. The electrical power component according to claim 9, whereby the one or more filler elements that are movably connected to the conductor rotate around the longitudinal axis of the housing.

11. The electrical power component according to claim 10, whereby a connector rotatably connects the one or more filler elements to the conductor.

12. The electrical power component according to claim 9, whereby the expansion vessel is arranged above the condenser core when the component is in a vertical position, and the inner diameter of the expansion vessel is larger than the inner diameter of the housing.

13. The electrical power component according to claim 9, whereby said one or more filler elements are made of a solid material.

14. The electrical power component according to claim 9, whereby said one or more filler elements are made of ceramic, metal or polymer.

15. The electrical power component according to claim 9, whereby said one or more filler elements contain one filler element having a size and shape, which at least partly correspond to the shape and size of the expansion vessel.

16. The electrical power component according to claim 15, whereby said filler element is shaped as a part of a cylinder.

17. The electrical power component according to claim 15, whereby the filler element is shaped as a cylinder having an indentation for housing the expansion gas.

18. The electrical power component according to claim 9, whereby the component is an electrical bushing.

* * * * *